United States Patent [19]

Graversen

[11] 4,114,806

[45] Sep. 19, 1978

[54] THERMOSTATICALLY ACTUATED REGULATOR FOR A 4-LEAD AIR CONDITIONING PLANT

[75] Inventor: Niels Peter Grand Graversen, Augustenborg, Denmark

[73] Assignee: Danfoss A/S, Nordborg, Denmark

[21] Appl. No.: 791,480

[22] Filed: Apr. 27, 1977

[30] Foreign Application Priority Data

May 3, 1976 [DE] Fed. Rep. of Germany ..... 2619413

[51] Int. Cl.[2] ..... G05D 23/12

[52] U.S. Cl. ..... 236/1 C; 236/91 D

[58] Field of Search ..... 236/1 C, 91 D, 93 A, 236/99 R, 99 E

[56] References Cited

U.S. PATENT DOCUMENTS

| | | | |
|---|---|---|---|
| 2,556,479 | 6/1951 | McGrath | 236/1 C |
| 3,182,909 | 5/1965 | Noakes | 236/1 C |
| 3,273,797 | 9/1966 | Grahl | 236/1 C |

*Primary Examiner*—Clarence R. Gordon

*Attorney, Agent, or Firm*—Wayne B. Easton

[57] ABSTRACT

The invention relates to an integrated thermostatic control system for cooling and heating. The control system includes cooling and heating valves and fluid pressure controlled operating elements for the valves. The system has a common sensor and a common variable chamber temperature setting unit. A capillary tube system connects the operating elements to the sensor and the temperature setting unit. An adjustable spring associated with either of the operating units biases the associated valve in the closing direction to provide an operationally dormant dead zone.

6 Claims, 2 Drawing Figures

THERMOSTATICALLY ACTUATED REGULATOR FOR A 4-LEAD AIR CONDITIONING PLANT

Figure 1:
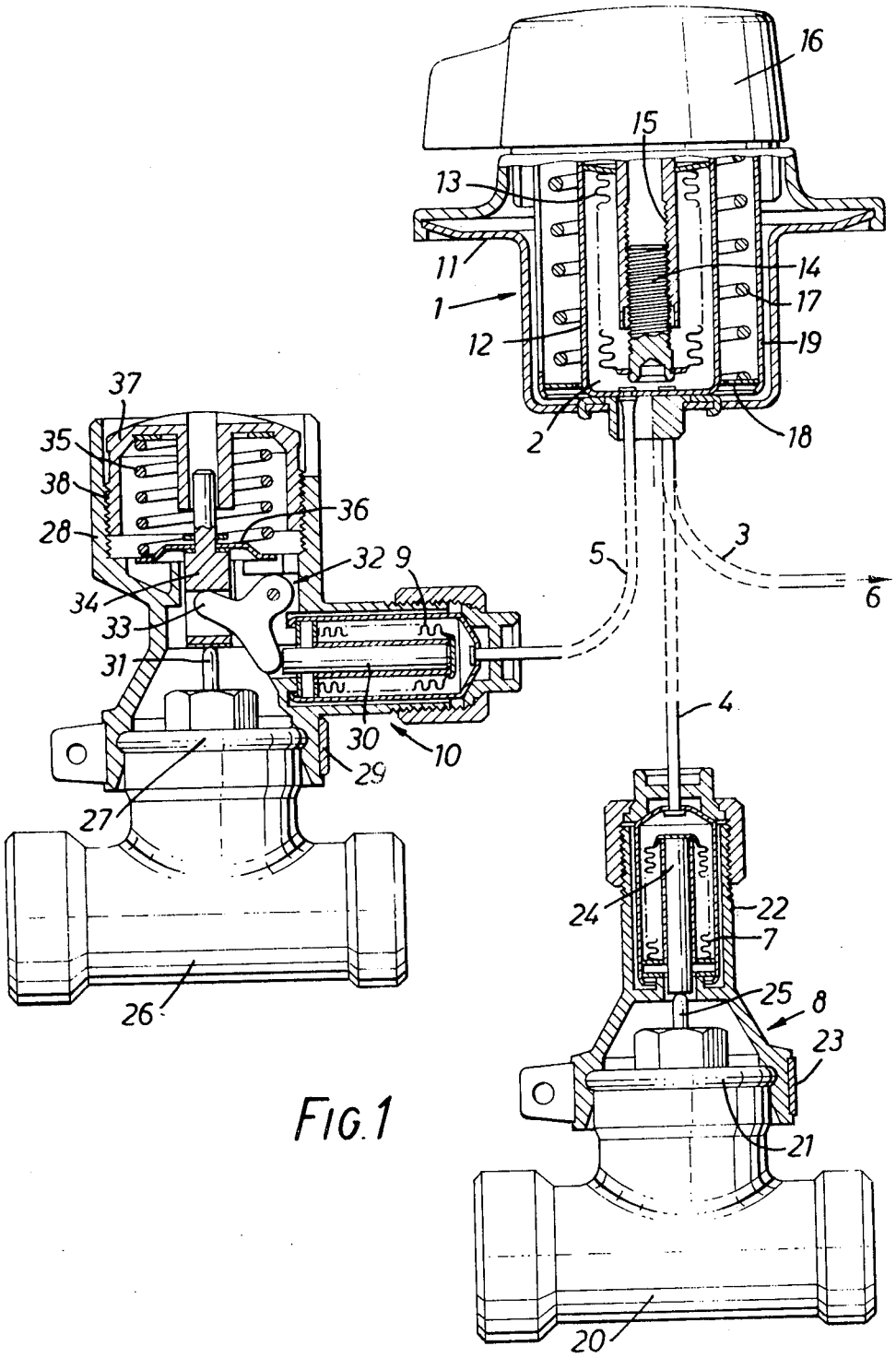

The invention relates to a thermostatically actuated regulator for a 4-lead air-conditioning plant, comprising a heating valve, a cooling valve, sensing means and common desired value setting means, a liquid serving as the expansion and transfer medium.

A regulator of this kind is known in which the heating valve controls the flow of a heating medium to a heat exchanger unit of the air-conditioning plant and the cooling valve controls the flow of a cooling medium thereto. The operating elements of both valves are parts of a respective own thermostatic system which, apart from the operating element, comprises a sensor and a variable desired value setting chamber. The two sensors are juxtaposed and therefore subjected to the same temperature. The setting means for the variable chambers are intercoupled by gearing and are adjusted in opposite senses by means of a common desired value setting button. To achieve clear regulating conditions, a spacing, hereinafter referred to as a 'dead zone' must be provided for all desired value settings between the temperature at which the heating valve closes and the temperature at which the cooling valve opens. This spacing can be achieved in that both variable desired value setting chambers are adjusted independently and only then intercoupled.

The invention is based on the problem of providing a thermostatically actuated regulator for a 4-lead air-conditioning plant of the aforementioned kind, which will be adequate with a smaller number of components.

This problem is solved according to the invention in that the operating elements of both valves, a common sensor and a common variable chamber of the setting means are interconnected to form a single thermostatic system of which the filling yields resiliently under the operating pressure, and that the closure member and associated operating element of at least one of the two valves is loaded in the closing direction by a dead zone spring which is preferably adjustable.

With such a regulator, the dead zone spring keeps the closure member of the one valve closed not only until the other valve has closed but until a sufficiently large force overcoming the force of the dead zone spring has been created by resilient yielding of the filling of the thermostatic system. To produce such resilient resetting forces within the filling, a further temperature rise is required. Within this temperature range, both valves are closed; a dead zone is therefore produced. The size of the dead zone can be changed by setting the dead zone spring. This feature makes it possible to dispense with a second thermostatic system, i.e. a sensor, one variable chamber of the setting means and the associated capillary tubes.

The axis of the adjustable dead zone spring is preferably at an angle to the axis of the operating element and both are coupled to one another by an angular lever. In this way the operating element is readily accessible for the purpose of replacement and the spring is conveniently accessible for the purpose of adjustment.

In a preferred embodiment, it is ensured that both valves have closure members which come to lie against a valve seat with increasing pressure loading, that the operating element of the heating valve acts on the associated closure member directly and the operating element of the cooling valve acts on the associated closure member with the interpositioning of motion reversing means, and that the reversing means comprise an adjustable closure spring dimensioned as a dead zone spring.

It is already known that one can use a valve as a heating valve with direct loading by the operating element and the same valve as a cooling valve when employing interposed motion reversing means with an adjustable closure spring. However, in the present case a heating valve of this construction and a cooling valve of this construction are controlled by a common thermostatic system, the closure spring being additionally dimensioned as a dead zone spring.

The easiest way of obtaining a resiliently yielding filling is by having an expansion liquid that is itself resilient. The properties of resilience of numerous known expansion liquids are adequate for the present purpose. Toluene is for example preferred.

Another possibility that can be used instead of or in conjunction with a resilient expansion liquid is that the thermostatic system comprises a deflection chamber with a wall which is resiliently deformable outwardly from a defined rest position. In particular, the wall can be loaded by a deflection spring.

Figure 2:
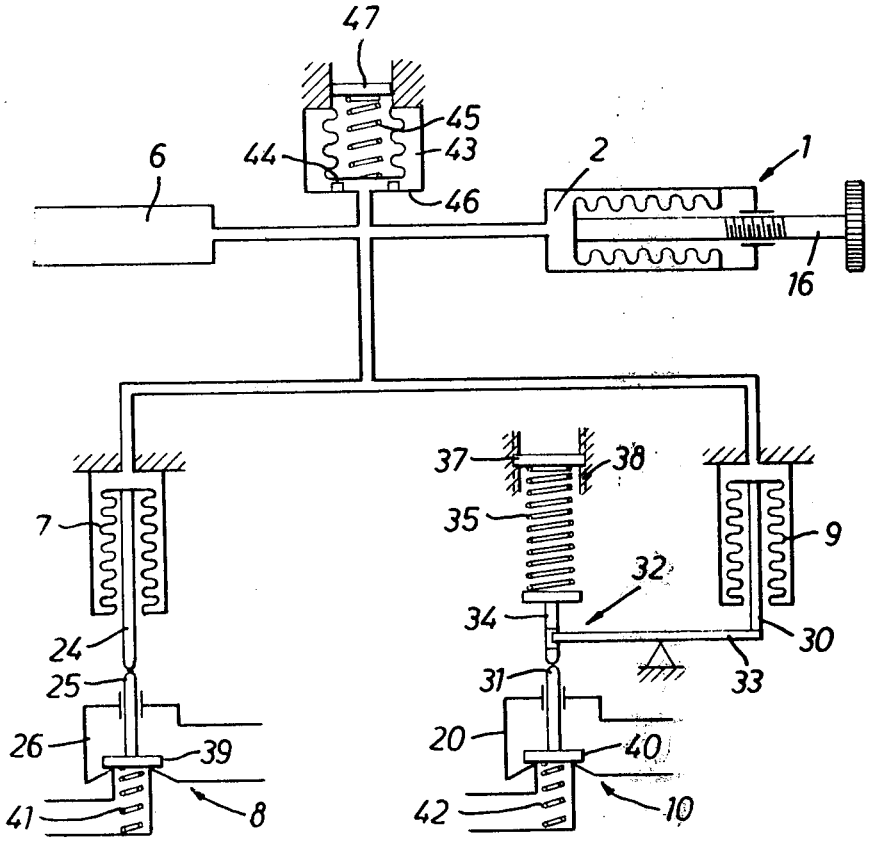

The invention will now be described in more detail with reference to the example illustrated in the drawing, wherein:

FIG. 1 is a part-sectional view of a heating valve, cooling valve and setting means of a regulator according to the invention, and FIG. 2 is a diagrammatic representation of a modified regulator.

FIG. 1 shows desired value setting means 1 of which the chamber 2 that is variable in volume is connected by three capillary tubes 3, 4 and 5 to the interior of a sensor 6 (not shown), the operating element 7 of a heating valve 8 and the operating element 9 of a cooling valve 10, respectively. The thermostatic system thus formed is filled with an expansion liquid which has a certain amount of resilience. By way of example, one may mention toluene which, at a temperature of 20° to 30° C. has a coefficient of expansion of $0.88 \times 10^{-4}$ cm²/kp.

The variable chamber 2 is bounded by a cup 12 connected to a housing 11 and corrugated tubular bellows 13. The base thereof is provided with a screw-threaded connector 14 over which there engages an internally screw-threaded hollow shank 15 which is rotatable by means of a knob 16 to vary the axial length of the bellows 13 and thus the size of the chamber 2. An overpressure spring 17 is supported against the housing by the end which is not shown and with its other end it lies against a counterbearing 18 which is non-positively connected to a collar of the hollow shank 15 by means of a bridge 19 that is held against rotation. If pressures are created in the thermostatic system that are so high that the comparatively large pretensioning of the overpressure spring 17 is overcome, the chamber 2 can expand correspondingly.

The heating valve 8 has a valve housing 20 with an upper bead 21 onto which an extension 22 can be clamped by means of a clamping strap 23. The operating element 7 possesses a shank 24 against which a pin 25 lies under the action of a spring (not shown). In the illustrated position, the pin 25 is pressed inwardly to such an extent that the closure member is on its seat.

The cooling valve 10 comprises a valve housing 26 which is identical with the valve housing 20. On its bead 27 an extension 28 is secured by means of a clamping strap 29 and it contains the operating element 9. However, its shank 30 does not act directly on the pin 31 of the valve housing 26 but with the interpositioning of motion reversing means 32. The latter comprise an angular lever 33 and a shank 34 which engages the pin 31 and is loaded in the closing direction by a dead zone spring 35. This spring is supported on the one side by a counterbearing 36 secured to the shank 34 and on the other side by a screw 37 in mesh with a screwthread 38 of the extension 28.

The same reference numerals as in FIG. 1 are used for corresponding components in FIG. 2. In addition, there are shown the two closure members 39 and 40 of the heating and cooling valve as well as the associated opening springs 41 and 42. Further, it will be recognized that the thermostatic system is connected to a deflection chamber 43 having a wall 44 loaded by a deflection spring 45. The latter normally presses the wall 44 against an abutment on the fixed wall 46 and its other end is supported by a screw 47.

The following function is obtained. If the room to be air-conditioned has a temperature of the desired value, both valves 8 and 10 are closed as shown in FIG. 2. If the temperature drops, the volume of the expansion liquid is reduced and the heating valve 8 opens. If the temperature now rises again, the heating valve 8 will close; however, the cooling valve 10 cannot yet open because the pretension of the dead zone spring 35 must first be overcome, which requires a pressure rise in the thermostatic system. This pressure rise is obtained when the sensor temperature is further increased. This is because the expanding liquid increases in volume which displaces the movable wall 44 and stresses the deflection spring 45; this produces an increase in pressure in the thermostatic system. As soon as the pretension of the dead zone spring 35 has been overcome, the cooling valve 10 opens. By adjusting the pretension of the dead zone spring 35 by means of the screw 37, the size of the dead zone can be varied. These conditions are retained even if the desired value is adjusted with the aid of the setting means 1.

In very many cases it is not, however, necessary to provide a deflection chamber 43 since the expansion liquid has an adequate amount of inherent resilience; on a rise in temperature in a thermostatic system of given volume, it therefore produces a resetting force which finally overcomes the pretension of the dead zone spring 35.

Account is taken not only of the pressure in the thermostatic system and the force of the dead zone spring 35 but also of the pressure of the heating medium or cooling medium on the closure members 39 or 40 and the resilient force of the tubular spring bellows in the operating element 7 and 9. However, all these values are taken into account when setting the dead zone by means of the dead zone spring 35.

I claim:

1. A thermostatic control system for cooling and heating, comprising, a cooling valve, a heating valve, a fluid pressure controlled operating element for each of said valves, common sensor means and common variable chamber setting means for said system, capillary tube means connecting said operating elements to said sensor means and said setting means, an expansion fluid in said system, and resilient means biasing at least one of said valves in a closing direction to provide an operationally dormat dead zone.

2. A system according to claim 1 wherein said expansion fluid yields resiliently under operating pressure.

3. A system according to claim 1 wherein said resilient means is an adjustable spring.

4. A system according to claim 3 wherein one of said valves has said spring associated therewith the spring axis thereof extending normal to the axis of the said operating element associated therewith, and level means connecting said spring to said last referred to operating element.

5. A system according to claim 4 wherein said spring is associated with said cooling valve.

6. A system according to claim 1 including an deflection chamber connected to said capillary tube means, and spring means loading said deflection chamber.

* * * * *